US005751142A

United States Patent [19]

Dosho et al.

[11] Patent Number: 5,751,142

[45] Date of Patent: May 12, 1998

[54] REFERENCE VOLTAGE SUPPLY CIRCUIT AND VOLTAGE FEEDBACK CIRCUIT

[75] Inventors: Shiro Dosho; Shiro Sakiyama; Masakatsu Maruyama, all of Osaka; Masatoshi Matsushita; Koji Mochizuki, both of Kanagawa, all of Japan

[73] Assignee: Matsushita Electric Industrial Co., Ltd., Osaka, Japan

[21] Appl. No.: 795,906

[22] Filed: Mar. 4, 1997

[30] Foreign Application Priority Data

Mar. 7, 1996 [JP] Japan ..... 8-050091

[51] Int. Cl.[6] ..... G05F 3/20

[52] U.S. Cl. ..... 323/316; 323/901; 323/314

[58] Field of Search ..... 323/316, 315, 323/313, 314, 901, 907; 363/49; 327/332, 538, 543

[56] References Cited

U.S. PATENT DOCUMENTS 5,119,015 6/1992 Watanabe ..... 323/313
5,604,428 2/1997 Koblitz et al. ..... 323/316

OTHER PUBLICATIONS

Randall L. Geiger et al. "VLSI Design Techniques For Analog And Digital Circuits" published by McGraw-Hill Publishing Company, pp. 366–369, 1990 ISBN 0-07-023253-9.

*Primary Examiner*—Peter S. Wong
*Assistant Examiner*—Shawn Riley
*Attorney, Agent, or Firm*—McDermott, Will & Emery

[57] ABSTRACT

A reference voltage output terminal of first and second reference voltage generating circuits is connected to a first current input terminal of a current mirror circuit of an operational amplifier by a diode element. At the time of start-up, a reference voltage generated on the reference voltage output terminal is 0 V. Consequently, a current flows to the diode element and an offset voltage Voff is generated on the operational amplifier so that a malfunction point is caused to disappear. Accordingly, in the case where a normal operation point on which a reference voltage having an expected value is generated and a malfunction point on which an operation is stabilized with a reference voltage having a value less than the expected value are present, the generated reference voltage is raised at the time of start-up, passes through the malfunction point to reach an expected voltage value on the normal operation point and becomes stabilized. In this state, the diode element is cut off so that the offset voltage Voff is caused to disappear.

24 Claims, 13 Drawing Sheets

REFERENCE VOLTAGE SUPPLY CIRCUIT AND VOLTAGE FEEDBACK CIRCUIT

BACKGROUND OF THE INVENTION

The present invention relates to a reference voltage supply circuit and a semiconductor circuit, and more particularly to improvement to stabilize operation start-up thereof on a normal operation point without stabilization on a malfunction point.

The reference voltage supply circuit serves to generate a constant reference voltage irrespective of a change in a temperature and a change in a supply voltage of the circuit. Various circuits have conventionally been devised. A reference voltage supply circuit which has been used most generally will be described below with reference to FIG. 13.

In FIG. 13, 7 denotes a current supply, 102*a* denotes a first reference voltage generating circuit including a resistance element 8 and a diode element 11. 102*b* denotes a second reference voltage generating circuit including two resistance elements 9 and 10 and a diode element 12. The first and second reference voltage generating circuits 102*a* and 102*b* share a reference voltage output terminal 102out and generate a reference voltage on the reference voltage output terminal 102out. 103 denotes an operational amplifier including a differential amplifying circuit 101 and an inversion amplifier 6. The differential amplifying circuit 101 has a current supply 1, two PMOS transistors 2 and 3, and two NMOS transistors 4 and 5. 110 denotes an inverter including a PMOS transistor 53 and an NMOS transistor 54. 23 denotes a voltage control switch for supplying a supply voltage to the reference voltage output terminal 102out on receipt of an output from the inverter 110.

A voltage input to a gate terminal of the PMOS transistor 2 is indicated at V1, a voltage input to a gate terminal of the PMOS transistor 3 is indicated at V2, and a reference voltage generated on the reference voltage output terminal 102out is indicated at Vout. Reverse saturation currents of the diode elements 11 and 12 are indicated at Is1 and Is2 respectively, values of the flowing currents are indicated at I1 and I2 respectively, and resistances of the resistance elements 8 to 10 are indicated at R1, R1 and R2 respectively. In this case, a relationship among the voltages Vout, V1 and V2 is expressed as follows.

$$I1=Is1\ (e^{(V1/nVt)}-1)$$

$$I2=Is2\ (e^{(Vd/nVt)}-1)$$

(Vd is a voltage of the diode element 12)

$$V2=R2*I2+Vd$$

The operational amplifier 103 generates a feedback voltage on the current supply 7 such that the input voltages V1 and V2 are equal to each other, and determines the reference voltage Vout.

$$V1=V2 \text{ or } I1*R1=I2*R2$$

Consequently, I1=I2 is obtained. Accordingly, the reference voltage Vout generated from the reference voltage output terminal 102out can be calculated by the above-mentioned equations in the following manner.

$$\text{Vout}=\text{nVt}*\log(\text{nVt}*\log(Is2/Is1)/R2/Is1+1)+R1/R2*\text{nVt}*\log(Is2/Is1) \quad (1)$$

More specifically, a term which represents the reference voltage Vout has no term which represents the supply voltage. For this reason, the reference voltage Vout is determined irrespective of the supply voltage. Polarities of temperature coefficients of a first term nVt*log(nVt*log(Is2/Is1)/R2/Is1+1) and a second term R1/R2*nVt*log(Is2/Is1) on a right side of Equation (1) are reverse to each other. By properly selecting R1/R2, consequently, the reference voltage Vout which is not varied with a change in a temperature can be generated.

However, the conventional reference voltage supply circuit has a problem that two DC stabilization points exist. This problem will be described below.

FIG. 8 (*a*) shows a relationship between the reference voltage Vout and the input voltages V1 and V2. As is apparent from FIG. 8 (*a*), a point on which the voltages V1 and V2 are equal to each other can also be formed with the reference voltage Vout=0 except for the value of the reference voltage Vout represented by the Equation (1). For reasons of characteristics of the operational amplifier 103, the circuit is stabilized on the following conditions if an offset voltage Voff is generated.

$$V2-\text{Voff}=V1$$

In this case, the input voltages V1 and V2 and the reference voltage Vout have a relationship shown in FIG. 8 (*b*). If the voltages V1 and V2 rise from a potential of 0 V, the circuit is stabilized on a malfunction point Vx before reaching a normal operation point so that the circuit does not operate normally.

In the prior art, a start-up circuit is formed by using the voltage control switch 23 and the inverter 110 shown in FIG. 13. More specifically, when a power supply is turned ON, an output of the inverter 110 is set High because the reference voltage Vout is 0 V at first. In that case, the reference voltage Vout is raised instantly up to the vicinity of the supply voltage if the voltage control switch 23 is formed so as to be turned ON at High. When the reference voltage Vout is raised, the output of the inverter 110 is set Low so that the voltage control switch 23 is turned OFF. In this state, when an output current of the current supply 7 is controlled so as to be decreased by an output of the operational amplifier 103 so that the input voltages V1 and V2 are lowered to reach the normal operation point of V1=V2, the generated reference voltage Vout is stabilized with an expected value.

However, the conventional reference voltage supply circuit has the following drawback. In the conventional reference voltage supply circuit, when the inverter 110 outputs a High signal by the reference voltage Vout during a normal operation in which the reference voltage Vout outputs an expected value, the voltage control switch 23 is turned ON so that the output voltage Vout is raised up to the vicinity of the supply voltage. Thus, a malfunction is caused. In order to surely prevent such a malfunction, it is necessary to set a threshold of the inverter 110 with high precision. However, analog circuits having the same structure are used in apparatus of a portable type and an installation type. For this reason, also in the case where a supply voltage of, for example, 2 V is used for the portable type and a supply voltage of, for example, 5 V is used for the installation type, a stable operation is required in both power supplies. Under the circumstances, a reference voltage supply circuit built in an electronic equipment needs to always operate normally even if a supply voltage to be used has various values, for example, 2 V, 5V and the like. On the other hand, the threshold of the inverter 110 is varied depending on the supply voltage. For this reason, even if the conventional reference voltage generating circuit is set with high precision so as to normally operate with a supply voltage having a predetermined value (for example, 2 V), it malfunctions with a supply voltage having other predetermined values (for example, 5 V) and an operation starts up stably with difficulties. Accordingly, in the case where the reference voltage supply circuit is used with a supply voltage having other predetermined values, it is necessary to reset the threshold of the inverter 110 with high precision. Thus, the reference voltage supply circuit is not general-purpose.

SUMMARY OF THE INVENTION

It is an object of the present invention to provide a reference voltage supply circuit which does not malfunction but can always start up stably with a supply voltage having various values, and is general-purpose.

In order to solve the above-mentioned problems, a first aspect of the present invention is to cause malfunction points to disappear so that the circuit can surely be stabilized on a normal operation point. A second aspect of the present invention is to form a start-up circuit by using a differential comparator without employing an inverter so that a threshold is not needed to be taken into consideration.

In order to achieve the above-mentioned object, the present invention provides a reference voltage supply circuit which operates stably on a normal operation point where a voltage value of a first internal part is coincident with that of a second internal part and on a stabilization point other than the normal operation point, comprising a current supply provided with a control terminal for causing a current to flow, the current having a value corresponding to a control signal input to the control terminal, first and second reference voltage generating circuits which share a reference voltage output terminal and receive the current from the current supply to generate a reference voltage on the reference voltage output terminal, and have the first and second internal parts to generate respective voltages thereon, an operational amplifier for inputting, as differential signals, the voltages of the first and second internal parts to amplify the differential signals, and for outputting one of two signals forming amplified differential signals from an output terminal to send the output signal as the control signal to the control terminal of the current supply, and a control circuit for monitoring a reference voltage generated on the reference voltage output terminal of the first and second reference voltage generating circuits when an operation of the reference voltage supply circuit starts up, and for generating an offset voltage between two voltages input to the operational amplifier to cause the stabilization point to disappear if the reference voltage is less than a set value.

The present invention provides the reference voltage supply circuit, wherein the control circuit serves to control the operational amplifier such that an offset voltage is not generated between the two voltages input to the operational amplifier if the reference voltages of the first and second reference voltage generating circuits are equal to or more than the set value.

Furthermore, the present invention provides the reference voltage supply circuit, wherein a differential comparator and a voltage control switch are provided in place of a control circuit, the differential comparator having two input terminals, the input terminals being connected to a point where a voltage is almost constant in the operational amplifier and the reference voltage output terminal of the first and second reference voltage generating circuits, respectively, and serving to compare the reference voltage of the reference voltage output terminal with the constant voltage, and the voltage control switch receiving a comparison result signal of the differential comparator and connecting a high voltage supply to the reference voltage output terminal of the first and second reference voltage generating circuits in response to the comparison result signal.

In addition, the present invention presents a voltage feedback circuit for feeding back an output voltage to a set voltage, comprising a current supply, a current supply having a feedback terminal and serving to cause a current to flow, the current having a value corresponding to a control signal input to the feedback terminal, first and second voltage generating circuits which share a voltage output terminal, receive the current from the current supply to generate a voltage and output the voltage from the voltage output terminal, and each generates a reference voltage in an internal predetermined part, an operational amplifier which inputs, as differential signals, the reference voltages of the first and second voltage generating circuits, amplifies the differential signals, outputs one of two signals forming amplified differential signals, and sends the output signal as the control signal to the feedback terminal of the current supply, and a control circuit for monitoring the voltages output from the voltage output terminal of the first and second voltage generating circuits when an operation of the voltage feedback circuit starts up, and for generating an offset voltage between two voltages input to the operational amplifier if the output voltage is less than a desired voltage value.

Furthermore, the present invention provides the voltage feedback circuit, wherein the control circuit serves to control the operational amplifier such that the offset voltage is not generated between the two voltages input to the operational amplifier if the voltage output from the voltage output terminal is equal to or more than the desired voltage value.

According to the above-mentioned structures, in the reference voltage supply circuit and the voltage feedback circuit of the present invention, the stable operation point (malfunction point) other then the normal operation point is caused to disappear with the offset voltage of the operational amplifier when the operation starts up so that stable operation can surely be performed at the normal operation point.

After the stable operation on the normal operation point, particularly, the offset voltage of the operational amplifier is extinguished. Consequently, the reference voltage generating circuit and the voltage feedback circuit output expected reference voltages with high precision.

The reference voltage supply circuit according to the present invention is activated by the operation of the voltage control switch based on the output of the differential comparator at the time of start-up. Consequently, it is not necessary to take a threshold into consideration unlike the case where a conventional inverter is used. Accordingly, the reference voltage supply circuit is not stabilized on the malfunction point but surely operates stably on the normal operation point with a supply voltage having various values.

The above-mentioned object and novel features of the present invention will become more apparent in conjunction with the following detailed description and the accompanying drawings.

BRIEF DESCRIPTION OF THE DRAWINGS

The accompanying drawings show the preferred embodiments of the present invention in which.

DETAILED DESCRIPTION OF THE INVENTION

Each preferred embodiment of the present invention will be described below with reference to the accompanying drawings.

(First Embodiment)

Figure 1:
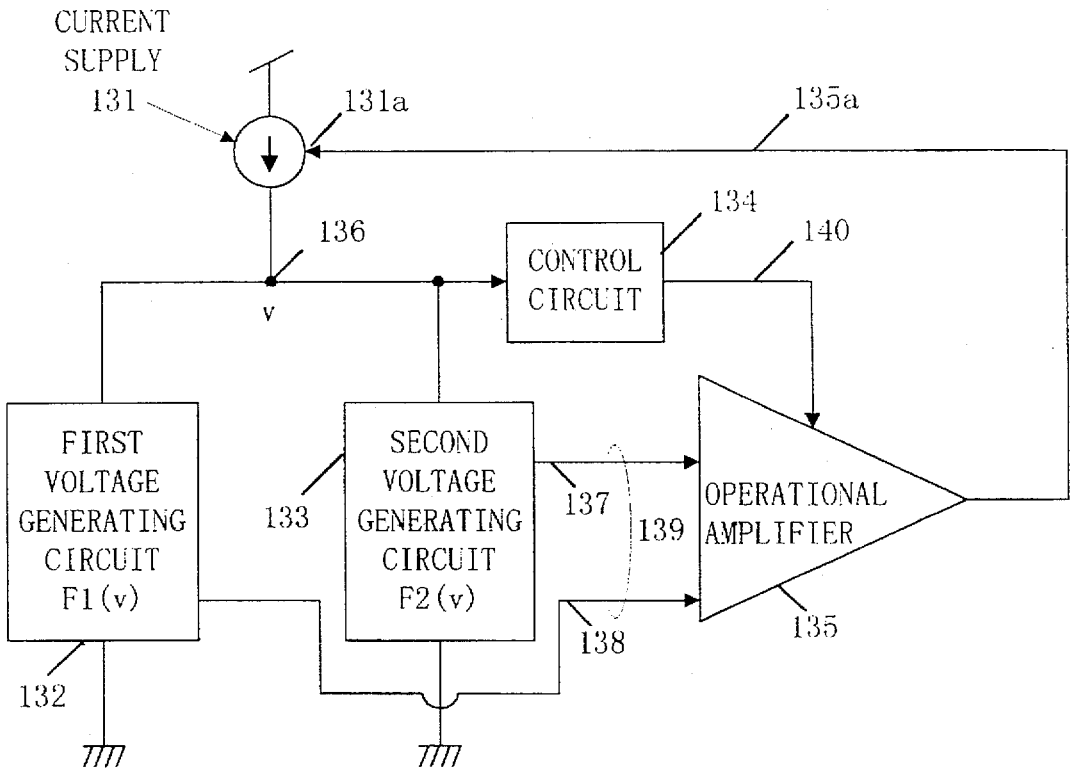
FIG. 1 is a diagram showing a whole structure of a voltage feedback circuit according to a first embodiment of the present invention.

FIG. 1 shows a voltage feedback circuit according to a first embodiment of the present invention. In FIG. 1, 131 denotes a current supply, 132 denotes a first voltage generating circuit, 133 denotes a second voltage generating circuit, 134 denotes a control circuit, and 135 denotes an operational amplifier.

The current supply 131 has a feedback terminal 131*a*, and outputs a current having a value corresponding to a control signal input to the feedback terminal 131*a*.

The first and second voltage generating circuits 132 and 133 share a voltage output terminal 136, and generate a voltage on the voltage output terminal 136 on receipt a current from the current supply 131. In the first and second voltage generating circuits 132 and 133, a reference voltage generated on each internal predetermined point is input as a differential signal 139 to the operational amplifier 135.

The operational amplifier 135 differentially amplifies a difference voltage between two signals 137 and 138 forming the input differential signal 139, and outputs, as a control signal 135*a*, one of two signals forming a differentially amplified signal to the feedback terminal 131*a* of the current supply 131.

The control circuit 134 stores, in advance, a plurality of desired voltage values to be generated on the voltage output terminal 136, and can select one of the desired voltage values. The control circuit 134 inputs a voltage generated on the voltage output terminal 136 when starting up an operation of the voltage feedback circuit, and compares the input voltage value with the selected desired voltage value. If the input voltage value is less than the desired voltage value, an offset control signal 140 is output to the operational amplifier 135. If the input voltage value is equal to or more than the desired voltage value, the output of the offset control signal 140 is stopped. The operational amplifier 135 gives an offset voltage Voff between the reference voltages 138 and 137 sent from the first and second voltage generating circuits 132 and 133 if it receives the offset control signal 140. When the difference voltage between the reference voltages 137 and 138 is coincident with the offset voltage Voff, the operational amplifier 135 does not output the control signal 135*a*.

A voltage generated on the voltage output terminal 136 is indicated at V, and the reference voltages of the first and second voltage generating circuits 132 and 133 are indicated at F1 (V) and F2 (V), respectively. The whole voltage feedback circuit is fed back such that the two input voltages F1 (V) and F2 (V) of the operational amplifier 135 are equal to each other, and the two reference voltages are stabilized on a point of F1 (V)=F2 (V). In this case, a voltage value V is output to the voltage output terminal 136.

However, if there are two or more points of F1 (V)=F2 (V), the voltage feedback circuit is stabilized on one of the points. Consequently, if a voltage value on the stabilization point is not a desired voltage value, the voltage feedback circuit malfunctions.

In the voltage feedback circuit according to the present embodiment, the control circuit 134 monitors the stabilized voltage value. If the stabilized voltage value is not the desired voltage value, the control circuit 134 causes the operational amplifier 135 to generate an offset voltage and controls the current supply 131 such that the voltage feedback circuit operates on another stabilization point. Then, when the voltage generated on the voltage output terminal 136 approaches the desired voltage value, the control circuit 134 causes the operational amplifier 135 to cancel the offset voltage, and controls the current supply 131 so as to be stabilized with the desired voltage value.

Accordingly, the voltage feedback circuit according to the present embodiment can be caused to surely operate stably on a desired operation point.

(Second Embodiment)

Figure 2:
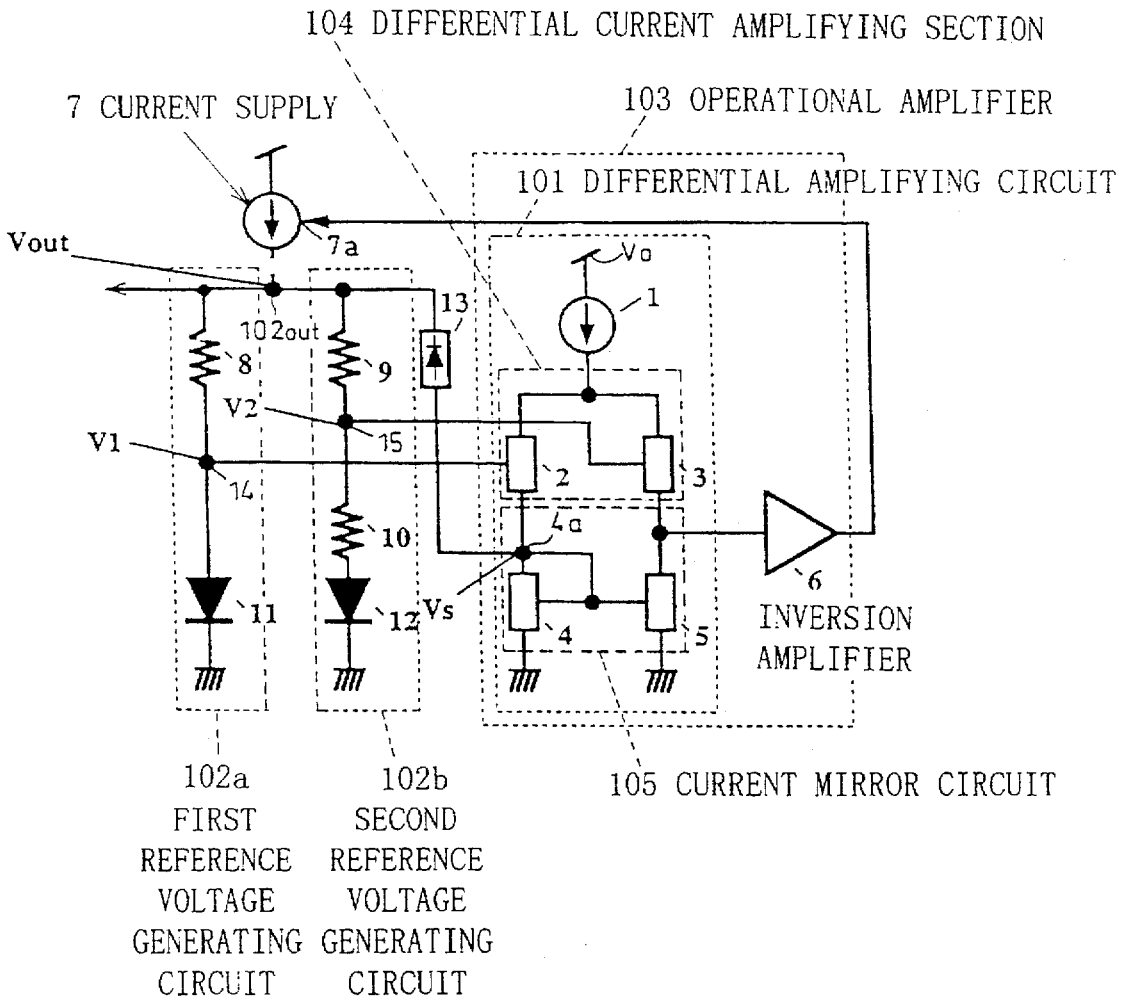
FIG. 2 is a diagram showing a whole structure of a reference voltage supply circuit according to a second embodiment of the present invention.

FIG. 2 shows a second embodiment of the present invention in which the above-mentioned voltage feedback circuit is applied to a reference voltage supply circuit.

In FIG. 2, 7 denotes a current supply having a control terminal 7*a*, 102*a* and 102*b* denote first and second reference voltage generating circuits respectively, 103 denotes an operational amplifier, and 13 denotes a control circuit.

Figure 3:
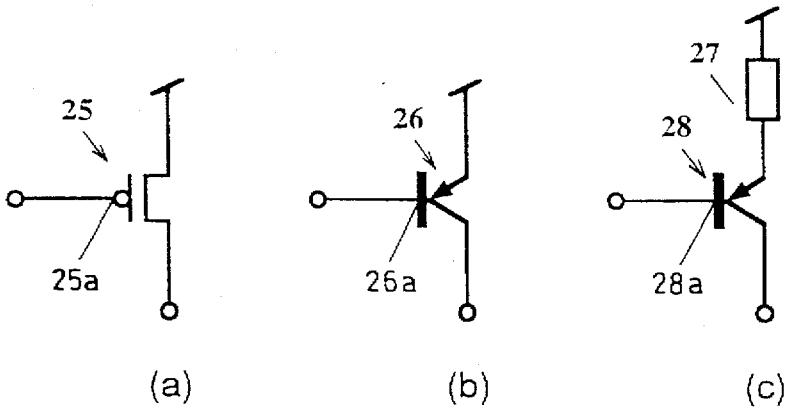
FIG. 3 (*a*) is a diagram showing a first example of a structure of a current supply, FIG. 3 (*b*) is a diagram showing a second example of the structure of the current supply, and FIG. 3 (*c*) is a diagram showing a third example of the structure of the current supply.

The current supply 7 causes a current to flow, the current having a value corresponding to a control signal input to the control terminal 7*a*. The current supply 7 is usually formed by a PMOS type transistor 25 shown in FIG. 3 (*a*), a PNP transistor 26 shown in FIG. 3 (*b*), or a resistance element 27 and a PNP transistor 28 shown in FIG. 3 (*c*). A current control terminal of each transistor acts as the control terminal 7*a*.

The first and second reference voltage generating circuits 102*a* and 102*b* share a reference voltage output terminal 102out. A current is supplied from the current supply 7 to the reference voltage output terminal 102out. The first reference voltage generating circuit 102*a* includes a resistance element 8 and a diode element 11. The resistance element 8 has one of ends connected to the reference voltage output terminal 102out, and the other end connected to an anode of the diode element 11. A cathode of the diode element 11 is connected to a low voltage supply (grounded). A node of the resistance element 8 and the diode element 11 is a first internal part 14. The second reference voltage generating circuit 102*b* includes a resistance element 9, a resistance element 10 and a diode element 12. The resistance element 9 has one of ends connected to the reference voltage output terminal 102out, and the other end connected to one of ends of the resistance element 10. The resistance element 10 has the other end connected to an anode of the diode element 12. A cathode of the diode element 12 is connected to a low voltage supply (grounded). A node of the resistance elements 9 and 10 is a second internal part 15.

Furthermore, the operational amplifier 103 comprises a differential amplifying circuit 101 and an inversion amplifier 6. The differential amplifying circuit 101 includes a constant current supply 1, a differential current amplifying section 104 having two transistors 2 and 3, and a current mirror circuit 105 having two transistors 4 and 5.

Figure 4:
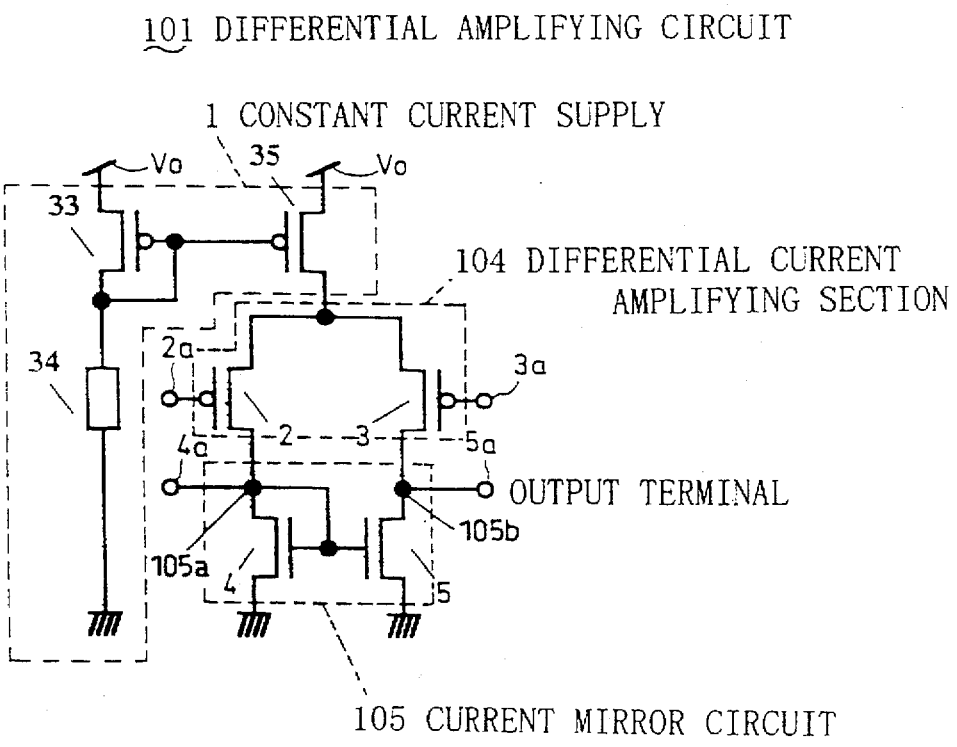
FIG. 4 is a diagram showing an example of a specific structure of a differential amplifying circuit.

FIG. 4 shows a specific internal structure of the differential amplifying circuit 101. In FIG. 4, the constant current supply 1 includes two PMOS transistors 33 and 35, each having one of ends connected to a high voltage supply Vo, and a resistance element 34. The PMOS transistor 33 and the resistance element 34 cooperate to generate a bias voltage to be supplied to a gate of the PMOS transistor 35. The PMOS transistor 35 supplies and outputs a constant current. The differential current amplifying section 104 is connected to the other end of the constant current supply 1 (that is, the other end of the PMOS transistor 35). In the differential current amplifying section 104, two transistors 2 and 3 are formed by first and second P type (first conductivity type) MOS transistors. In each of the transistors 2 and 3, one of ends (source) is connected to the constant current supply 1 and the other end (drain) is connected to the current mirror circuit 105, and a gate takes each of a positive-phase-sequence input terminal 2*a* and a negative-phase-sequence input terminal 3*a* of the differential amplifying circuit 101 to which voltages V1 and V2 of the first and second internal parts 14 and 15 of the first and second reference voltage generating circuits 102*a* and 102*b* are input as differential signals. The differential signals are amplified. In the current mirror circuit 105, the two transistors 4 and 5 are formed by N type (second conductivity type) MOS transistors whose ends (drains) act as first and second current input terminals 105*a* and 105*b*. The terminals 105*a* and 105*b* are connected to the other ends (drains) of the MOS transistors 2 and 3 of the differential current amplifying section 104, respectively. The transistors 4 and 5 have the other ends (sources) connected to low voltage supplies (grounded), and gates connected in common. This node is connected to the first current input terminal 105*a*. Accordingly, the current mirror circuit 105 extracts, from the second current input terminal 105*b*, a current having a value which is proportional to a value of a current input to the first current input terminal 105*a* and having the same polarity as that of the current. The first current input terminal 105*a* is connected to an offset voltage control terminal 4*a*, and the second current input terminal 105*b* acts as an output terminal 5*a* of the differential amplifying circuit 101. When a current having a predetermined value is extracted from the offset voltage control terminal 4*a*, a balance of two currents flowing from the differential current amplifying section 104 of the differential amplifying circuit 101 is lost so that an offset voltage Voff is given to the two input voltages V1 and V2 applied to the differential current amplifying section 104.

Figure 5:
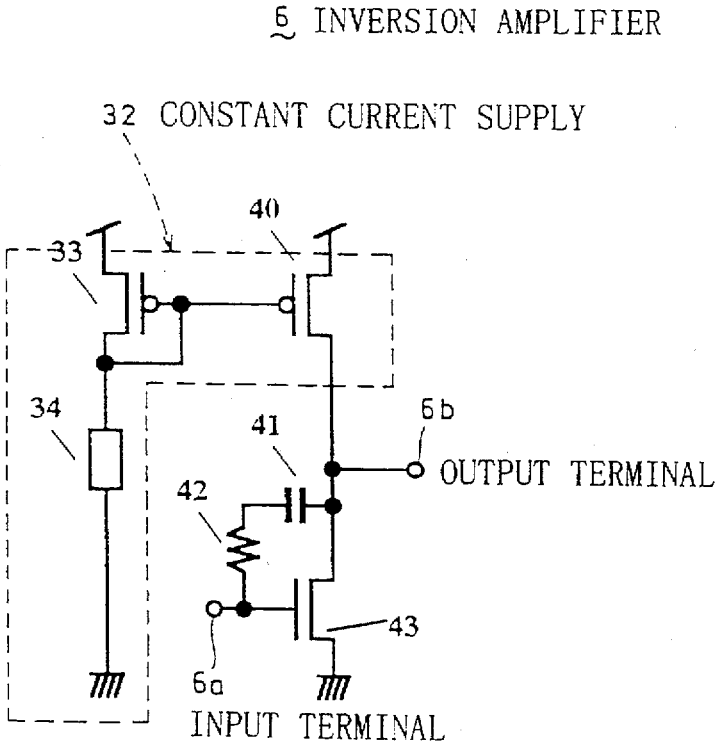
FIG. 5 is a diagram showing an example of a specific structure of an inversion amplifying circuit.

FIG. 5 shows an internal structure of the inversion amplifier 6. The internal structure is generally used as an inversion amplifier in the case where the differential amplifying circuit 101 is formed by a MOS transistor. In FIG. 5, 32 denotes a constant current supply including two PMOS transistors 33 and 40 and a resistance element 34. The PMOS transistor 33 and the resistance element 34 cooperate to generate a bias voltage to be supplied to the PMOS transistor 40, and the PMOS transistor 40 supplies a constant current. 41 denotes a capacitive element, 42 denotes a resistance element and 43 denotes an NMOS transistor. A gate 6*a* of the NMOS transistor 43 acts as an input terminal to input a signal output from the output terminal 5*a* of the differential amplifying circuit 101. This signal is inverted and amplified, and is then output from an output terminal 6*b*. The amplified signal output from the output terminal 6*b* is input as a control signal to the control terminal 7*a* of the current supply 7. If two input voltages V1 and V2 of the operational amplifier 103 have a relationship of V1>V2, the inversion amplifier 6 outputs a LOW signal and the current supply 7 increases a magnitude of an output current. If the input voltages V1 and V2 of the operational amplifier 103 have a relationship of V1<V2, the inversion amplifier 6 outputs a HIGH signal and the current supply 7 reduces the magnitude of the output current. The capacitive element 41 and the resistance element 42 serve to compensate for a phase of the circuit. In addition to the structure of the inversion amplifier 6 shown in FIG. 5, an optional circuit having inverting and amplifying functions can be employed.

Figure 6:
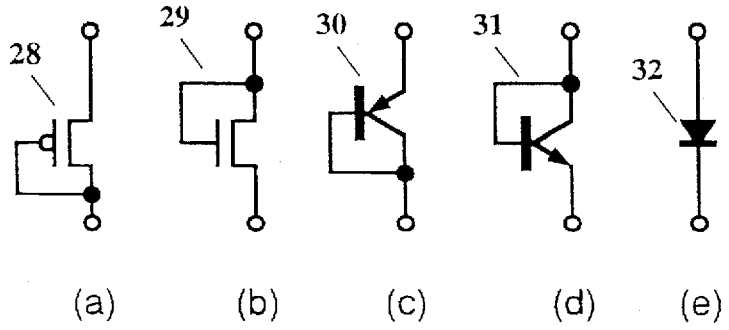
FIG. 6 (*a*) is a diagram showing a first example of a structure of a diode element forming a control circuit, FIG. 6 (*b*) is a diagram showing a second example of the structure of the diode element forming the control circuit, FIG. 6 (*c*) is a diagram showing a third example of the structure of the diode element forming the control circuit, FIG. 6 (*d*) is a diagram showing a fourth example of the structure of the diode element forming the control circuit, and FIG. 6 (*e*) is a diagram showing a fifth example of the structure of the diode element forming the control circuit.

The control circuit 13 is formed by a diode element. The diode element has a structure which can realize a rectifying function, for example, a structure in which a PMOS transistor 28, an NMOS transistor 29, a PNP transistor 30 and an NPN transistor 31 are diode-connected or a structure using a PN junction diode 32 or the like as shown in FIGS. 6 (*a*) to 6 (*e*). The diode element has an anode connected to the reference voltage output terminal 102out, and a cathode connected to the offset voltage control terminal 4*a* of the operational amplifier 103. If a reference voltage Vout generated on the reference voltage output terminal 102out is less than a voltage (set value) Vs of the offset voltage control terminal 4*a* of the operational amplifier 103 (that is, the first current input terminal 105*a* of the current mirror circuit 105) (Vout<Vs), a current flows to the diode element and is extracted from the offset voltage control terminal 4*a* and an offset voltage Voff is generated between the voltages V1 and V2 input to the operational amplifier 103. If Vout is equal to or more than Vs, the diode element blocks a current flow to extinguish the offset voltage Voff. The set value Vs is set to a voltage value (for example, 0.9 V) between a reference voltage (for example, 1.1 V) on a normal operation point and a reference voltage Vx (Vx<1.1 V) on a malfunction point as shown in FIG. 8 (*b*).

The operation will be described below. The reference voltage supply circuit according to the present embodiment is a feedback system. An output current of the current supply 7 is controlled by the differential amplifying circuit 101 such that the input voltages V1 and V2 of the differential amplifying circuit 101 are coincident with each other, and the voltages V1 and V2 finally become equal to each other so that a DC operation point of the reference voltage supply circuit is stabilized. In this case, a relationship between the output reference voltage Vout and the voltages V1 and V2 is shown in FIG. 8 (*a*). As described above, a conventional problem is that there are two DC stabilization points. In consideration of the state of V1=V2=0 V, the output of the operational amplifier 103 is a HIGH signal. As a result, the current supply 7 is cut off. When the current supply 7 is cut off, this circuit is stabilized because of V1=V2=0 V. As shown in FIG. 8 (*b*), in the case where the offset voltage Voff is generated between the two input voltages for reasons of characteristics of the operational amplifier 103 and the reference voltage supply circuit is stabilized on the condition of V2–Voff=V1, the voltages V1 and V2 are stabilized on a malfunction point of V1=V2=Vx so that the reference voltage Vout of the reference voltage output terminal 102out is not raised up to a normal output voltage (about 1.1 V).

Figure 8:
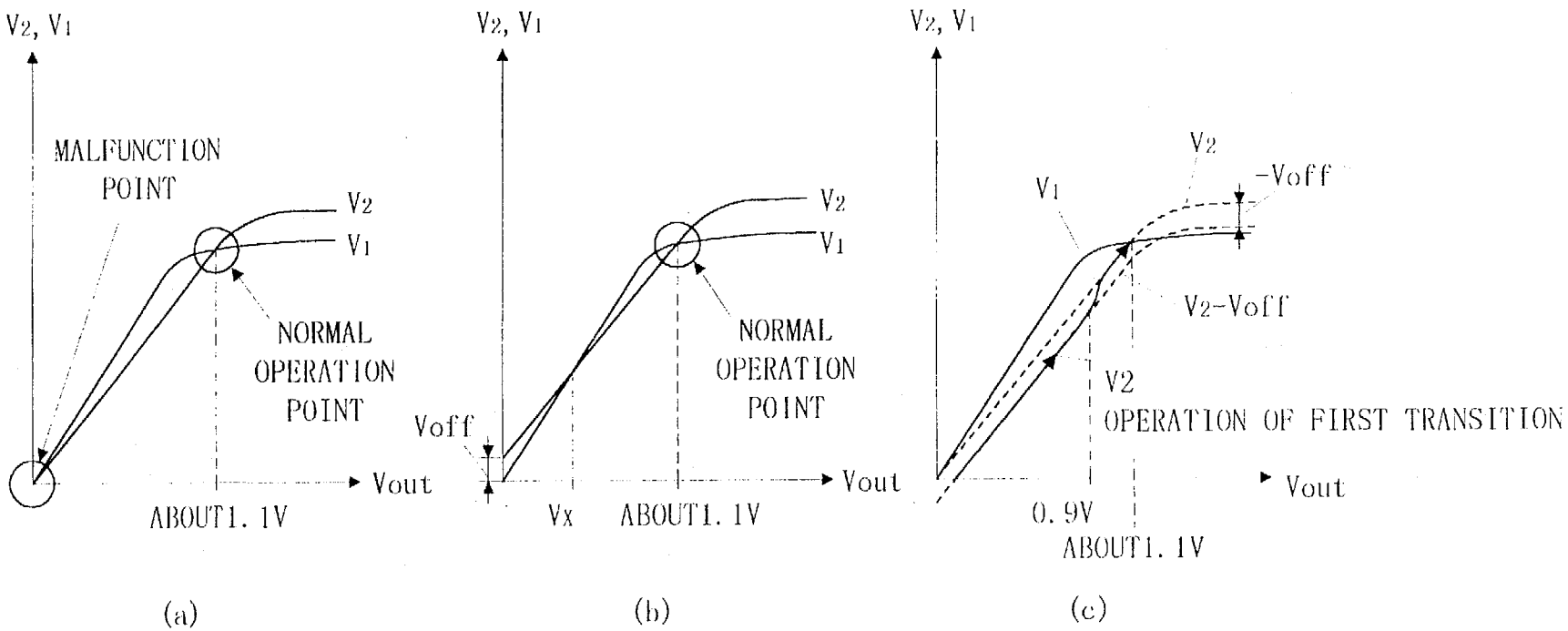
FIG. 8 (*a*) is a chart for explaining a malfunction point, FIG. 8 (*b*) is a chart for explaining a malfunction point obtained in the case where an operational amplifier has an offset voltage, and FIG. 8 (*c*) is a chart for explaining an operation performed in the case where the malfunction point is caused to disappear according to the present invention.

According to the present embodiment, a reverse offset voltage Voff (V1–Voff=V2) is intentionally applied to the operational amplifier 103 as shown in FIG. 8 (*c*) in order to erase the malfunction point. Accordingly, the malfunction point is erased so that the reference voltage Vout is always stabilized on the normal operation point.

In that case, when the offset voltage Voff is regularly applied to the operational amplifier 103, an error is made on the output voltage Vout of the reference voltage supply circuit and furthermore the output voltage of the reference voltage supply circuit fluctuates with variations in a supply voltage and a temperature so that precision of the output voltage is deteriorated.

In order to eliminate this drawback in the present embodiment, the offset voltage is applied to the operational amplifier 103 at the time of first transition of the reference voltage supply circuit, and the operational amplifier 103 is controlled such that the offset voltage is not generated after the first transition of the reference voltage supply circuit.

According to the present embodiment, the reference voltage output terminal 102out is connected to the offset voltage control terminal 4*a* of the operational amplifier 103 by the control circuit (diode element) 13 so that the operation amplifier 103 having a variable offset voltage is realized as described above.

Figure 7:
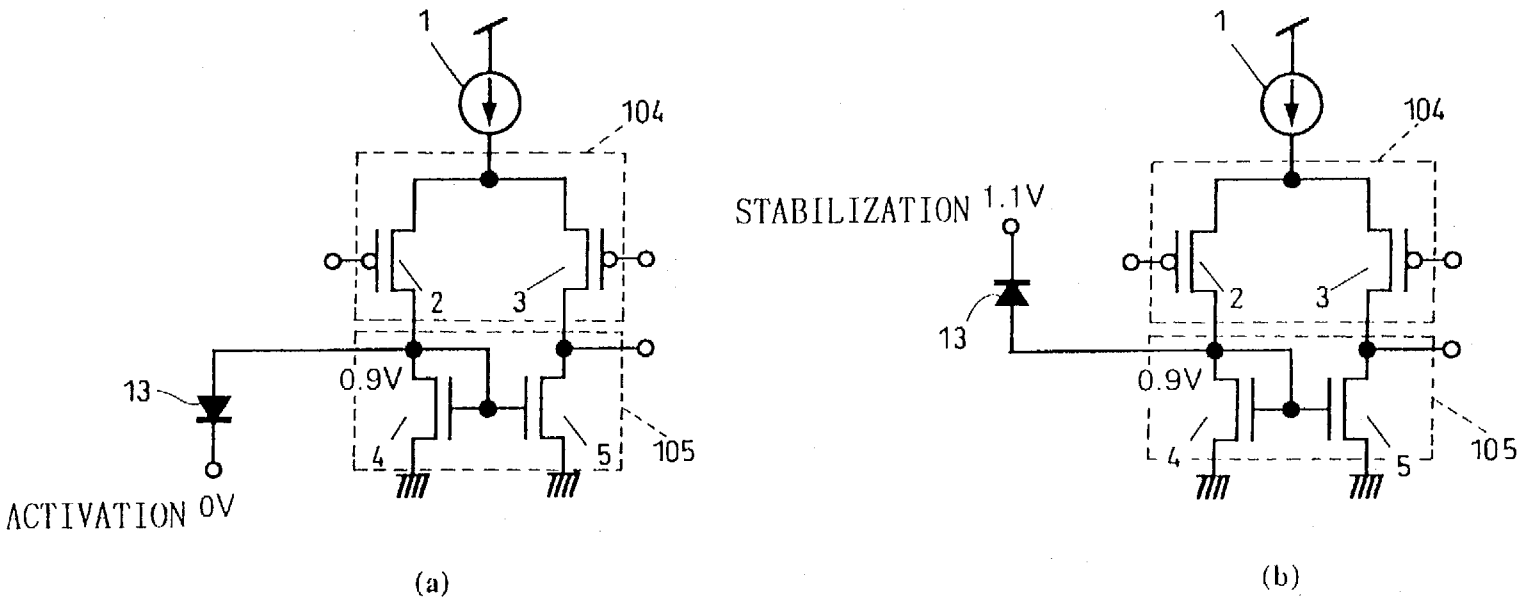
FIG. 7 (*a*) is a diagram typically showing an action of a diode element obtained when a reference voltage supply circuit according to a second embodiment of the present invention starts up, and FIG. 7 (*b*) is a diagram typically showing an action of the diode element during stabilization of an operation of the reference voltage supply circuit.

The principle will be described below with reference to FIG. 7. When the reference voltage supply circuit is activated, a voltage of the offset voltage control terminal 4*a* of the operational amplifier 103, that is, a voltage of the first current input terminal 105*a* of the current mirror circuit 105, namely, a drain voltage of the NMOS transistor 4 is set to about 0.9 V. In other words, the drain voltage of the NMOS transistor 4 is equal to a gate-source voltage. The gate-source voltage is set higher than a threshold voltage (usually, about 0.7 V) of the NMOS transistor 4 by about 0.2 V. Since the reference voltage Vout of the reference voltage output terminal 102out is 0 V at the time of start-up, a current flows to the diode element 13 as shown in FIG. 7 (*a*). In the differential current amplifying section 104, the PMOS transistor 2 should cause a current to flow more than in the PMOS transistor 3 according to a current flow to the diode element 13. Consequently, the gate voltage of the PMOS transistor 2 becomes lower than that of the PMOS transistor 3. More specifically, the offset voltage Voff is generated so that a voltage (V2–Voff) becomes equal to the voltage V1. Accordingly, when the reference voltage Vout is raised, the voltage V1 is raised along a curve V1 and the voltage V2 is raised along a curve (V2–Voff) as shown in FIG. 8 (*c*).

Then, when the reference voltage Vout reaches the voltage of the offset voltage control terminal 4*a* (that is, 0.9 V), the diode element 13 is cut off to be brought into the non-connection state. Consequently, a current flow is stopped so that the offset voltage Voff is extinguished. Accordingly, the voltage V2 is transferred to a curve V2 and is raised along the curve V2 as shown in FIG. 8 (*c*).

When the reference voltage Vout reaches about 1.1 V (the output voltage Vout is calculated by the Equation (1) and can be set in a range from about 1.1 V to 1.2 V if R1/R2=10 and Is2/Is1=10), the voltages V1 and V2 are coincident with each other on an intersection of the curves V1 and V2 shown in FIG. 8 (*c*) where the reference voltage supply circuit is stabilized. The intersection is the normal operation point of the reference voltage supply circuit. Accordingly, the reference voltage supply circuit starts up and is stabilized for an operation on the normal operation point.

The present embodiment can provide the reference voltage supply circuit having high precision in which the offset voltage is generated on the operational amplifier 103 by the action of the diode element 13 to cause the malfunction point to disappear when the reference voltage supply circuit starts up, and the offset voltage is extinguished during the stabilization of the operation so that a reference voltage having an expected value can be generated.

(Third Embodiment)

Figure 9:
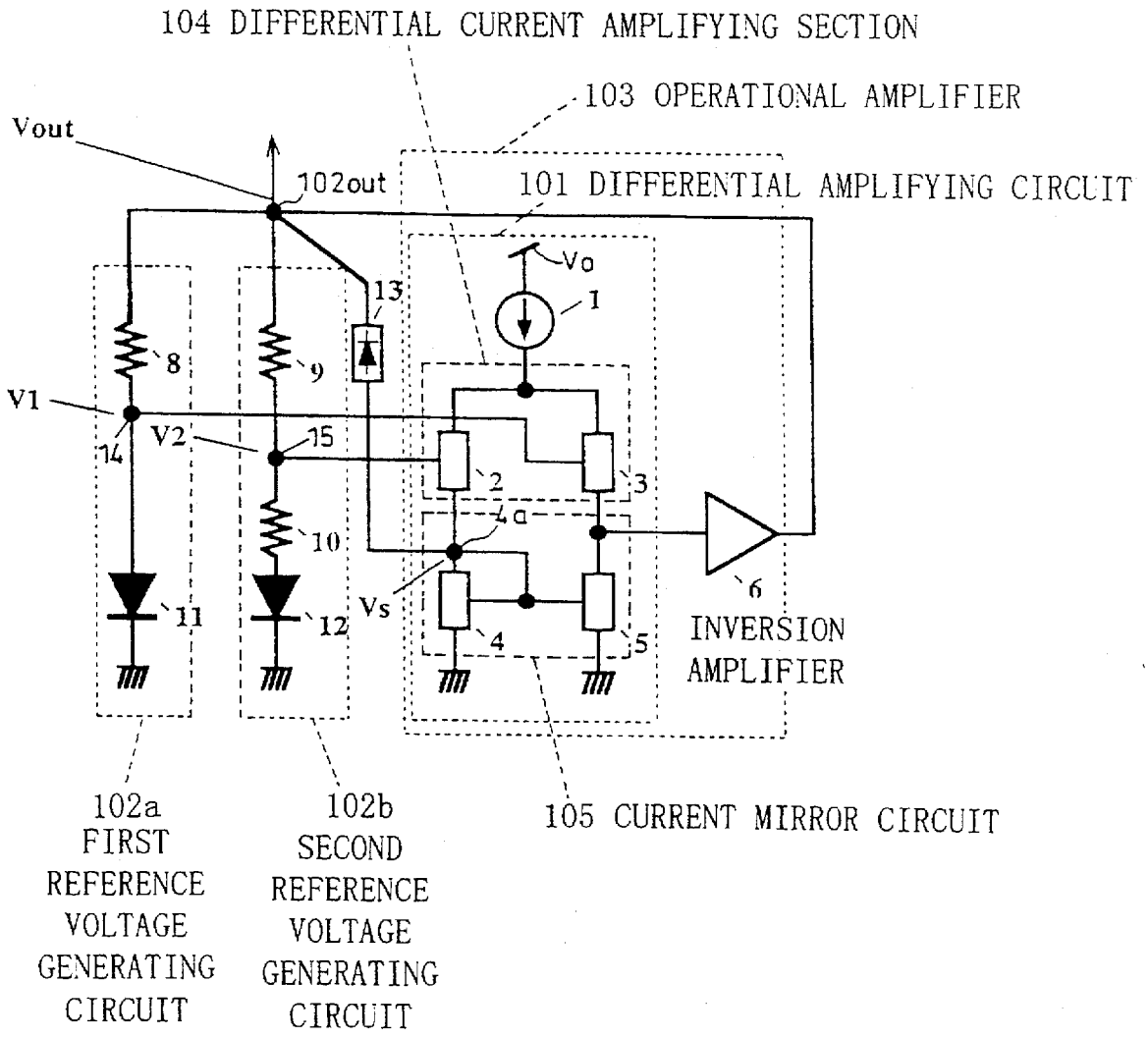
FIG. 9 is a diagram showing a whole structure of a reference voltage supply circuit according to a third embodiment of the present invention.

FIG. 9 shows a reference voltage supply circuit according to a third embodiment of the present invention. The present embodiment differs from the second embodiment in that the current supply 7 shown in FIG. 2 is removed, an output of an inversion amplifier 6 is directly supplied to a reference voltage output terminal 102out so that a reference voltage Vout is generated on the output terminal 102out. Other structures are the same as in the second embodiment.

With a circuit structure according to the present embodiment, a diode element 13 operates in just the same manner as in the second embodiment. An offset voltage Voff of an operational amplifier 103 exists at the time of start-up, and is extinguished after the reference voltage supply circuit is stabilized. Thus, the present embodiment can provide the reference voltage supply circuit which is not stabilized but rises on a malfunction point and is stabilized on a normal operation point, and generates a reference voltage having an expected value so as to operate with high precision.

(Fourth Embodiment)

A reference voltage supply circuit according to a fourth embodiment of the present invention will be described below with reference to FIG. 10.

Figure 10:
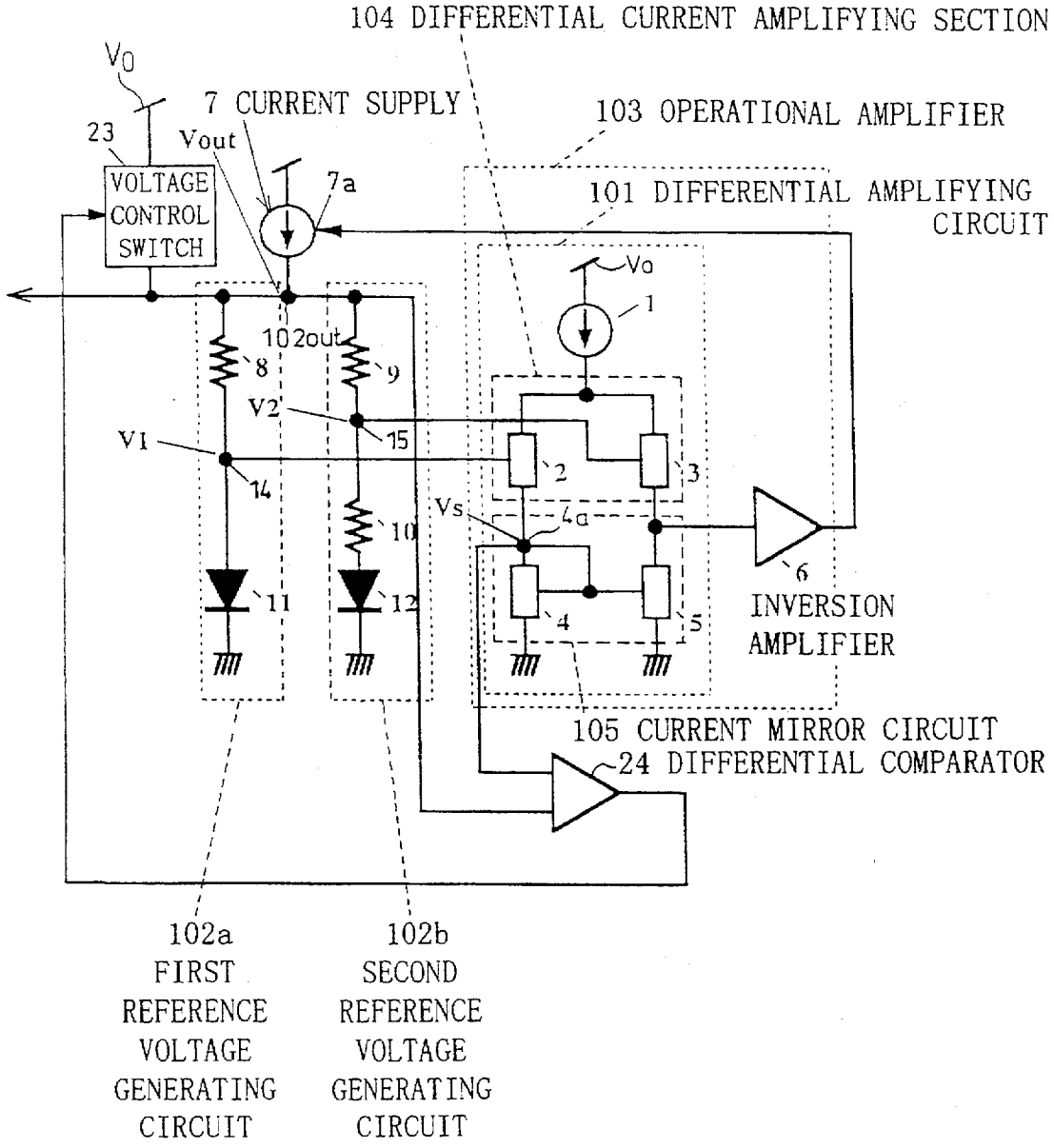
FIG. 10 is a diagram showing a whole structure of a reference voltage supply circuit according to a fourth embodiment of the present invention.

In FIG. 10, a differential comparator 24 is provided in place of the control circuit (diode element) 13 according to the second embodiment, and a conventional voltage control switch 23 is provided. When the voltage control switch 23 is turned ON, a high voltage supply Vo is connected to a reference voltage output terminal 102out to set an output reference voltage Vout to a supply voltage. Since other structures are the same as in FIGS. 2 to 4 according to the second embodiment, their description will be omitted.

Two input terminals of the differential comparator 24 are connected to the reference voltage output terminal 102out and an offset voltage control terminal 4*a* of an operational amplifier 103, respectively. A voltage of the offset voltage control terminal 4*a* of the operational amplifier 103 (that is, a voltage of a first current input terminal 105*a* of a current mirror circuit 105, namely, a drain voltage of an NMOS transistor 4) is represented by Vs. The voltage Vs is fixed to an almost constant voltage (about 0.9 V). The reference voltage Vout of the reference voltage output terminal 102out is set to 0 V at first, and is raised to about 1.1 V when the reference voltage supply circuit rises. Accordingly, an output of the differential comparator 24 has polarities reverse to each other when the reference voltage supply circuit starts up and after it is stabilized. When the reference voltage supply circuit starts up, the voltage control switch 23 is turned ON by the output of the differential comparator 24 (a comparison result signal).

Figure 11:
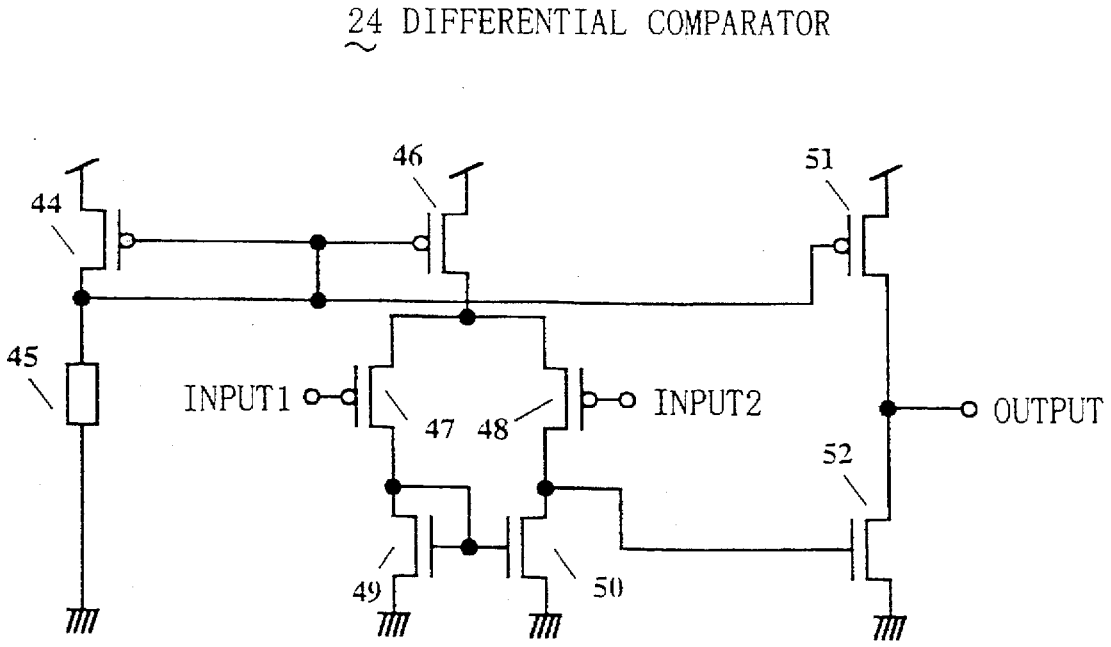
FIG. 11 is a diagram showing an example of a specific structure of a differential comparator.

FIG. 11 shows an example of a structure of the differential comparator 24. In FIG. 11, 44, 46 and 51 denote PMOS transistors, 45 denotes a resistance element, 47 and 48 denote PMOS transistors, 49 and 50 denote NMOS transistors, and 52 denotes an NMOS transistor. Gates of the PMOS transistors 47 and 48 are two input terminals, and a drain of the NMOS transistor 52 is an output terminal. The structure shown in FIG. 11 is an example of a circuit. The differential comparator 24 can have any structure in which an input. differential voltage can be amplified.

Accordingly, the reference voltage Vout of the reference voltage output terminal 102out is temporarily raised instantly to a supply voltage when the reference voltage supply circuit starts up, and is then lowered and stabilized on a normal operation point. Consequently, the reference voltage supply circuit is stabilized on the normal operation point in advance without stabilization on a malfunction point so that a normal operation can surely be performed.

Figure 13:
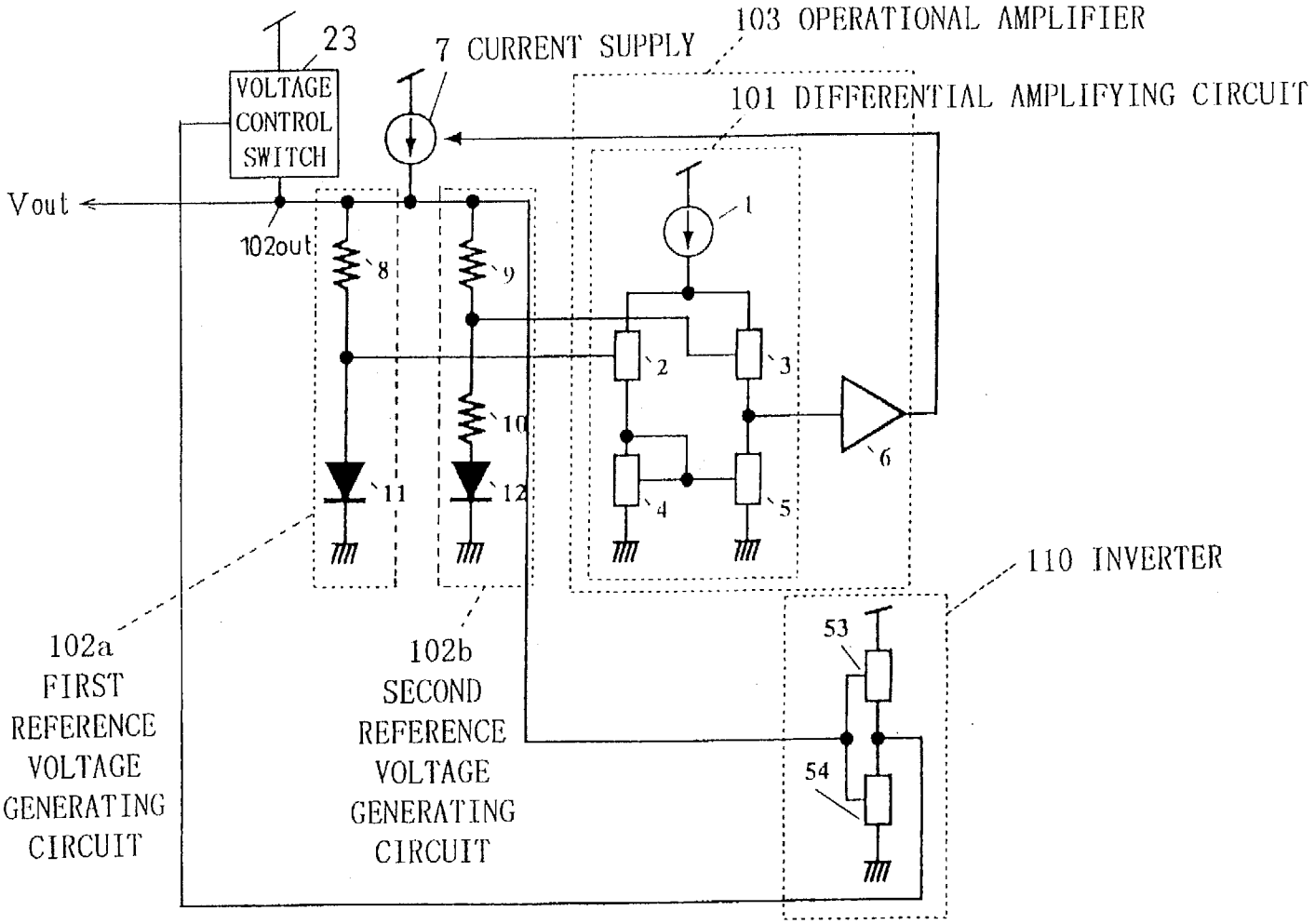
Fig. 13 PRIOR ART
FIG. 13 is a diagram showing a whole structure of a reference voltage supply circuit according to the prior art.

After the reference voltage supply circuit rises, an output polarity of the differential comparator 24 becomes reverse to that obtained at the time of start-up. Therefore, the voltage control switch 23 is turned OFF so that the operation of the circuit is not affected. According to the present embodiment, consequently, the voltage control switch 23 is not caused to operate by using the inverter 110 shown in FIG. 13 unlike the prior art but is caused to operate by using the differential comparator 24. Therefore, it is not necessary to take a threshold into consideration. Accordingly, also in the case where a supply voltage having various values is used, the reference voltage supply circuit can always be stabilized on the normal operation point without stabilization on the malfunction point.

(Fifth Embodiment)

Figure 12:
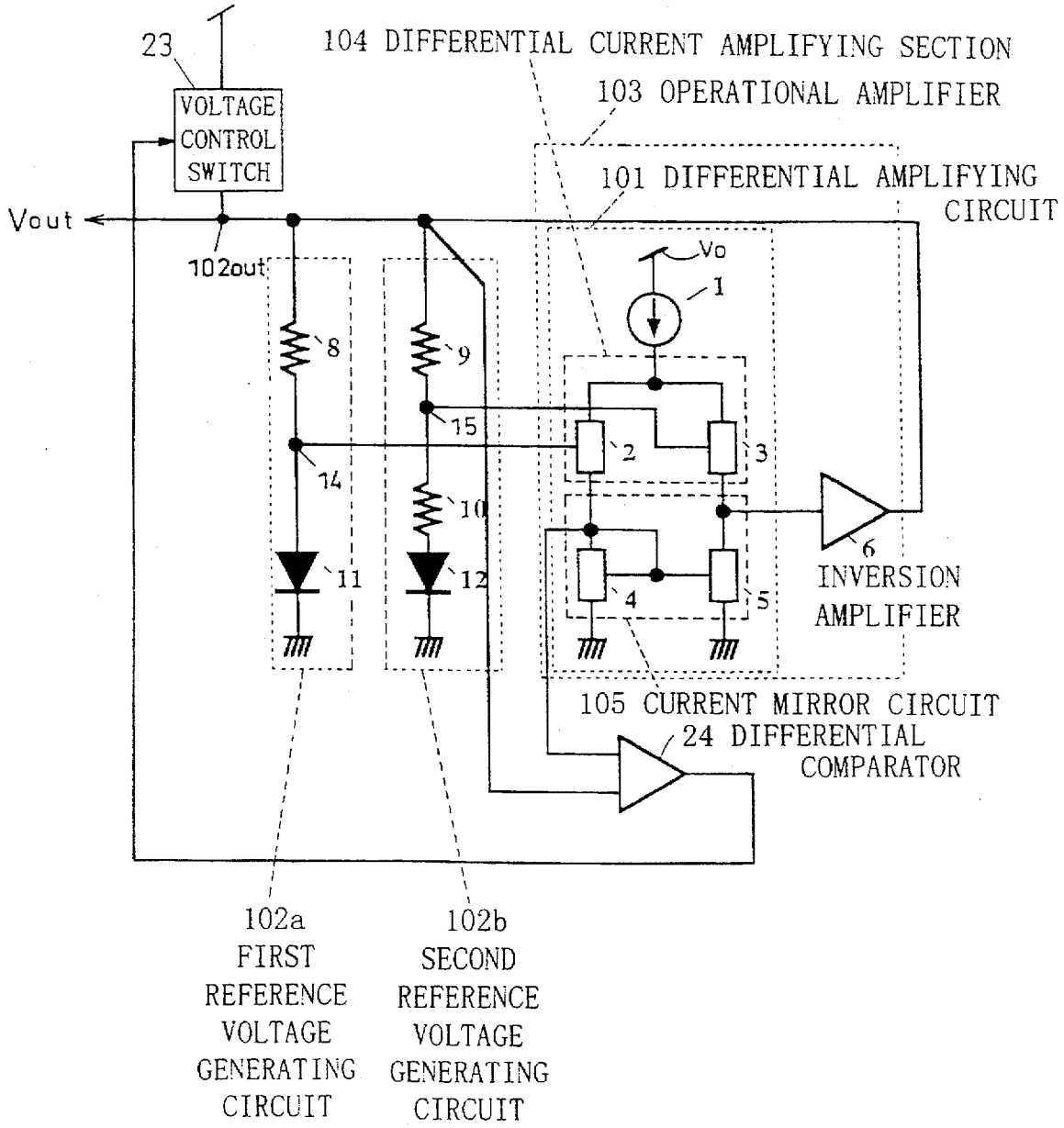
FIG. 12 is a diagram showing a whole structure of a reference voltage supply circuit according to a fifth embodiment of the present invention.

A reference voltage supply circuit according to a fifth embodiment of the present invention will be described below with reference to FIG. 12.

The present embodiment differs from the fourth embodiment in that the current supply 7 shown in FIG. 10 is removed and an output of an inversion amplifier 6 is directly supplied to a reference voltage output terminal 102out. Other structures are the same as in the fourth embodiment.

With a circuit structure according to the present embodiment, accordingly, the output of the inversion amplifier 6 is utilized to generate a reference voltage Vout on the reference voltage output terminal 102out. Consequently, if a voltage control switch 23 is caused to operate by using the above-mentioned differential comparator 24, the reference voltage supply circuit can be caused to rise stably.

While the voltage feedback circuit is applied to the reference voltage supply circuit as described above, it is needless to say that the voltage feedback circuit according to the present invention may be applied to other semiconductor circuits.

Although the present invention has fully been described by way of example with reference to the accompanying drawings, it is to be understood that various changes and modifications will be apparent to those skilled in the art. Therefore, unless otherwise such changes and modifications depart from the scope of the invention, they should be construed as being included therein.

We claim:

1. A reference voltage supply circuit which operates stably on a normal operation point where a voltage value of a first internal part is coincident with that of a second internal part and on a stabilization point other than the normal operation point, comprising:

a current supply provided with a control terminal for causing a current to flow, the current having a value corresponding to a control signal input to the control terminal;

first and second reference voltage generating circuits which share a reference voltage output terminal and receive the current from the current supply to generate a reference voltage on the reference voltage output terminal, and have the first and second internal parts to generate respective voltages thereon;

an operational amplifier for inputting, as differential signals, the voltages of the first and second internal parts to amplify the differential signals, and for outputting one of two signals forming amplified differential signals from an output terminal to send the output signal as the control signal to the control terminal of the current supply; and a control circuit for monitoring a reference voltage generated on the reference voltage output terminal of the first and second reference voltage generating circuits when an operation of the reference voltage supply circuit starts up, and for generating an offset voltage between two voltages input to the operational amplifier to cause the stabilization point to disappear if the reference voltage is less than a set value.

2. The reference voltage supply circuit of claim 1, wherein the set value to be used in the control circuit is a voltage value between a value of the reference voltage on the normal operation point and that of the reference voltage on the stabilization point.

3. The reference voltage supply circuit of claim 1, wherein the control circuit serves to control the operational amplifier such that an offset voltage is not generated between the two voltages input to the operational amplifier if the reference voltages of the first and second reference voltage generating circuits are equal to or more than the set value.

4. The reference voltage supply circuit of claim 1, wherein the operational amplifier has a differential amplifying circuit, the differential amplifying circuit including:

a constant current supply;

a differential current amplifying section to which a current is supplied from the constant current supply and the voltages of the first and second internal parts of the first and second reference voltage generating circuits are input as differential signals and which amplifies the differential signals; and a current mirror circuit having first and second current input terminals to which amplified differential signals of the differential current amplifying section are input, and serving to extract, from the second current input terminal, a current having a value proportional to a value of a signal input to the first current input terminal and the same polarity as that of the signal, the second current input terminal being an output terminal of the differential amplifying circuit.

5. The reference voltage supply circuit of claim 4, wherein the operational amplifier further includes an inversion amplifier, the inversion amplifier having a constant current supply built therein, and serving to invert and amplify a voltage of the output terminal of the differential amplifying circuit.

6. The reference voltage supply circuit of claim 1, wherein the current supply has a transistor, the transistor having a current control terminal thereof allocated as the control terminal.

7. The reference voltage supply circuit of claim 5, wherein the current supply is shared by the inversion amplifier.

8. The reference voltage supply circuit of claim 1, wherein the first reference voltage generating circuit includes:

a resistance element having one of ends connected to the current supply; and a diode element having an anode connected to the other end of the resistance element, and a cathode connected to a low voltage supply, a node of the resistance element and the diode element being the first internal part, and a node of the current supply and the resistance element being the reference voltage output terminal.

9. The reference voltage supply circuit of claim 1, wherein the second reference voltage generating circuit includes:

a resistance element having one of ends connected to the current supply;

another resistance element having one of ends connected to the other end of the resistance element; and a diode element having an anode connected to the other end of the another resistance element, and a cathode connected to a low voltage supply, a node of the resistance element and the another resistance element being the second internal part, and a node of the resistance element and the current supply being the reference voltage output terminal.

10. The reference voltage supply circuit of claim 3, wherein the control circuit is formed by a diode element, the diode element having an anode connected to a first current input terminal of a current mirror circuit of the operational amplifier, and a cathode connected to the reference voltage output terminal of the first and second reference voltage generating circuits.

11. The reference voltage supply circuit of claim 10, wherein the diode element is formed by diode-connected transistors or a junction diode.

12. A reference voltage supply circuit which operates stably on a normal operation point where a voltage value of a first internal part is coincident with that of a second internal part and on a stabilization point other than the normal operation point, comprising:

a current supply provided with a control terminal for causing a current to flow, the current having a value corresponding to a control signal input to the control terminal;

first and second reference voltage generating circuits which share a reference voltage output terminal and receive the current from the current supply to generate a reference voltage on the reference voltage output terminal, and have the first and second internal parts to generate respective voltages there on; and an operational amplifier for inputting, as differential signals, the voltages of the first and second internal parts to amplify the differential signals, and for outputting one of two signals forming amplified differential signals from an output terminal to send the output signal as a control signal to the control terminal of the current supply;

a differential comparator having two input terminals, the input terminals being connected to a point where a voltage is almost constant in the operational amplifier and the reference voltage output terminal of the first and second reference voltage generating circuits, respectively, and serving to compare the reference voltage of the reference voltage output terminal with the constant voltage; and a voltage control switch for receiving a comparison result signal of the differential comparator and for connecting a high voltage supply to the reference voltage output terminal of the first and second reference voltage generating circuits in response to the comparison result signal.

13. The reference voltage supply circuit of claim 12, wherein the operational amplifier has a differential amplifying circuit, the differential amplifying circuit including:

a constant current supply;

a differential current amplifying section to which a current is supplied from the constant current supply and the voltages of the first and second internal parts of the first and second reference voltage generating circuits are input as differential signals and which amplifies the differential signals; and a current mirror circuit having first and second current input terminals to which amplified differential signals of the differential current amplifying section are input, and serving to extract, from the second current input terminal, a current having a value proportional to a value of a signal input to the first current input terminal and the same polarity as that of the signal, the second current input terminal being an output terminal of the differential amplifying circuit.

14. The reference voltage supply circuit of claim 13, wherein the point where the voltage is almost constant in the operational amplifier is the first current input terminal of the current mirror circuit.

15. The reference voltage supply circuit of claim 13, wherein the operational amplifier further includes an inversion amplifier, the inversion amplifier having a constant current supply built therein, and serving to invert and amplify a voltage of the output terminal of the differential amplifying circuit.

16. The reference voltage supply circuit of claim 12, wherein the current supply has a transistor, the transistor having a current control terminal thereof allocated as the control terminal.

17. The reference voltage supply circuit of claim 15, wherein the current supply is shared by the inversion amplifier.

18. The reference voltage supply circuit of claim 12, wherein the first reference voltage generating circuit includes:

a resistance element having one of ends connected to the current supply; and a diode element having an anode connected to the other end of the resistance element, and a cathode connected to a low voltage supply, a node of the resistance element and the diode element being the first internal part, and a node of the current supply and the resistance element being the reference voltage output terminal.

19. The reference voltage supply circuit of claim 12, wherein the second reference voltage generating circuit includes:

a resistance element having one of ends connected to the current supply;

another resistance element having one of ends connected to the other end of the resistance element; and a diode element having an anode connected to the other end of the another resistance element, and a cathode connected to a low voltage supply, a node of the resistance element and the another resistance element being the second internal part, and a node of the resistance element and the current supply being the reference voltage output terminal.

20. The reference voltage supply circuit of claim 12, wherein the voltage control switch connects the high voltage supply to the reference voltage output terminal of the first and second reference voltage generating circuits on receipt of the comparison result signal of the differential comparator sent when the constant voltage on the point of the operational amplifier is higher than the reference voltages of the first and second reference voltage generating circuits.

21. A voltage feedback circuit for feeding back an output voltage to a set voltage, comprising:

a current supply;

a current supply having a feedback terminal and serving to cause a current to flow, the current having a value corresponding to a control signal input to the feedback terminal;

first and second voltage generating circuits which share a voltage output terminal, receive the current from the current supply to generate a voltage and output the voltage from the voltage output terminal, and each generates a reference voltage in an internal predetermined part;

an operational amplifier which inputs, as differential signals, the reference voltages of the first and second voltage generating circuits, amplifies the differential signals, outputs one of two signals forming amplified differential signals, and sends the output signal as the control signal to the feedback terminal of the current supply; and a control circuit for monitoring the voltages output from the voltage output terminal of the first and second voltage generating circuits when an operation of the voltage feedback circuit starts up, and for generating an offset voltage between two voltages input to the operational amplifier if the output voltage is less than a desired voltage value.

22. The voltage feedback circuit of claim 21, wherein the desired voltage value of the control circuit can be changed into any of a plurality of preset voltage values.

23. The voltage feedback circuit of claim 21, wherein the control circuit serves to control the operational amplifier such that the offset voltage is not generated between the two voltages input to the operational amplifier if the voltage output from the voltage output terminal is equal to or more than the desired voltage value.

24. The voltage feedback circuit of claim 21, the voltage feedback circuit forming a reference voltage supply circuit for generating a reference voltage.

* * * * *

UNITED STATES PATENT AND TRADEMARK OFFICE

CERTIFICATE OF CORRECTION

PATENT NO. : 5,751,142

DATED : May 12, 1998

INVENTOR(S) : DOSHO et al.

It is certified that error appears in the above-identified patent and that said Letters Patent is hereby corrected as shown below:

Col. 16, line 1: Delete entire line

Signed and Sealed this

Sixth Day of October, 1998

*Attest:*

*Attesting Officer*

BRUCE LEHMAN

*Commissioner of Patents and Trademarks*